United States Patent [19]

Curiel

[11] Patent Number: 4,998,989

[45] Date of Patent: Mar. 12, 1991

[54] TAMPER EVIDENT CLOSURE AND ASSOCIATED METHOD

[75] Inventor: Yoram Curiel, Aurora, Colo.

[73] Assignee: TSL Incorporated, Aurora, Colo.

[21] Appl. No.: 529,342

[22] Filed: May 25, 1990

Related U.S. Application Data

[63] Continuation-in-part of Ser. No. 347,363, May 4, 1989, Pat. No. 4,928,837.

[51] Int. Cl.[5] ..... B65D 51/00

[52] U.S. Cl. ..... 215/250; 215/230

[58] Field of Search ..... 215/250, 230

[56] References Cited

U.S. PATENT DOCUMENTS

| | | | |
|---|---|---|---|
| 1,664,635 | 4/1928 | Magill | 215/233 |
| 1,670,450 | 5/1928 | Henry | 215/250 |
| 2,074,490 | 3/1937 | Schwartz | 220/1 |
| 2,127,548 | 8/1938 | Boyle et al. | 73/51 |
| 2,131,774 | 10/1938 | Waring | 215/251 |
| 3,415,402 | 12/1968 | Webber | 215/1 |
| 3,662,915 | 5/1972 | Destler, Jr. | 220/27 |
| 3,783,089 | 1/1974 | Hurst et al. | 161/166 |
| 3,786,777 | 1/1974 | Smith et al. | 116/114 AB |
| 3,935,960 | 2/1976 | Cornell | 220/265 |
| 3,984,005 | 10/1976 | Amberg | 215/230 |
| 4,012,553 | 3/1977 | Clemens | 428/285 |
| 4,098,577 | 7/1978 | Halpern | 206/459 X |
| 4,181,223 | 1/1980 | Millet | 220/265 X |
| 4,424,252 | 1/1984 | Nativi | 428/209 |
| 4,436,203 | 3/1984 | Reyner | 206/807 |
| 4,449,632 | 5/1984 | Marusiak, Jr. | 206/807 |
| 4,451,523 | 5/1984 | Nativi et al. | 428/209 |
| 4,479,585 | 10/1984 | Sandhaus | 215/250 X |
| 4,502,605 | 3/1985 | Wloszczyna | 215/230 |
| 4,505,399 | 3/1985 | Weiner | 215/230 |
| 4,516,679 | 5/1985 | Simpson et al. | 206/459 |
| 4,546,881 | 10/1985 | Tasma | 206/459 |
| 4,566,627 | 1/1986 | Gendron | 206/807 |
| 4,576,297 | 3/1986 | Larson | 215/250 |
| 4,718,553 | 1/1988 | Adamoli et al. | 206/459 |
| 4,747,499 | 5/1988 | Gach et al. | 215/250 |
| 4,749,084 | 6/1988 | Pereyra | 206/459 |
| 4,759,445 | 7/1988 | McVay | 206/524.2 |
| 4,928,837 | 5/1990 | Curiel | 215/250 |
| 4,980,763 | 1/1990 | Curiel | 220/455 |

*Primary Examiner*—Steven M. Pollard

*Attorney, Agent, or Firm*—Arnold B. Silverman; David V. Radack

[57] ABSTRACT

A resilient closure snap fit onto a container having an end wall provided with a plurality of transverse grooves. A resin is deposited on the top surface of the end wall and into the grooves. If the closure is removed from the container, the top layer of resin and a portion of the resin in the grooves will fracture, thus indicating to the consumer that tampering with the container has occurred.

In another embodiment, the closure comprises a rotatable portion and a fixed portion. The rotatable and fixed portion have grooves which are filled with a resin. When the rotatable portion is pivoted away from the fixed portion to open the container, a portion of the resin fractures, thus indicating tampering with the container.

In another embodiment, the tamper evident closure comprises a closure body having an end wall and a skirt depending from the end wall and a closure lid movably secured to the closure body. The end wall and the closure lid define an upwardly open recess. A cured brittle layer is disposed in the upwardly open recess such that a portion of the layer contacts the end wall and another portion of the layer contacts the closure lid, whereby relative movement of the closure lid away from the end wall will cause a readily visible irreversible fracture of the layer and separation of at least one piece of the layer from the closure lid and the end wall. An associated method is also provided.

43 Claims, 7 Drawing Sheets

TAMPER EVIDENT CLOSURE AND ASSOCIATED METHOD

CROSS REFERENCE TO RELATED APPLICATION

This application is a continuation-in-part of U.S. Pat. Application Ser. No. 07/347,363 filed May 4, 1989, now U.S. Pat. No. 4,928,837.

BACKGROUND OF THE INVENTION

1. Field Of The Invention

This invention relates to a tamper evident closure and an associated method, and more specifically, it relates to a closure having a resin applied to the exterior thereof which will indicate if tampering has occurred.

2. Description Of The Prior Art

The tampering with and adulteration of many commercially available products have become critical problems endangering health and destroying purity of many products. Many products which are adulterated or tampered with ultimately reach a consumer bearing no visible indication that such adulteration or tampering has occurred. Accordingly, it is highly desirable to provide a type of packaging that will provide an indication that there has been interference with the integrity of the product packaging.

Various types of mechanical indicators used to determine the integrity of several types of products and containers are known.

U.S. Pat. No. 3,662,915 relates to a tamperproof package which provides a recessed tab in the inner periphery of a container which breaks away from the remainder of the container when entry is made into the container. This serves to indicate that tampering with the package has occurred.

U.S. Pat. No. 2,131,774 discloses a closure having a sealing liner. A disc of fibrous material is placed between the closure and the sealing liner. When the closure is removed, the disc will rupture the closing liner. See also, U.S. Pat. Nos. 4,576,297 and 4,747,499.

It has been known to provide for rupturing of outer coatings which fracture responsive to operation of a container tear strip. See U.S. Pat. No. 3,415,402. See also U.S. Pat. No. 4,479,585.

U.S. Pat. No. 4,749,084 discloses a tamper-indicating package having a web formed from two coextensive webs. Each web contains an outer layer, an inner sealable layer and an intermediate layer comprising filaments. The filaments are disposed in a random manner, thus, each package has its own unique "fingerprint". In use, the sender of the package can prepare an image of the package and send this image to the recipient of the package. In order to determine whether the package has been tampered with, the recipient can compare the images prepared by the sender with the arrangements of the filaments in the package.

My U.S. Pat. No. 4,890,763, the disclosure of which is expressly incorporated herein by reference, discloses a tamper resistant package and a method of making the same. An outer protective layer of an epoxide resin is placed on a package and is subsequently cured by ultraviolet radiation. This causes the outer layer to become extremely brittle such that any physical penetration of the outer layer will cause the entire outer layer to fracture. Such fracturing will provide a clear visual indication that penetration of the outer layer has occurred as by cracking of the material and separation of the pieces from the package.

In spite of the existing prior art techniques, there remains a need for an effective method of indicating that a closure has been tampered with or adulterated. There also remains a need for a closure to indicate whether or not the tamperproofing means has been placed on the closure by the manufacturer.

SUMMARY OF THE INVENTION

The present invention has met the above-described need. In one embodiment, a resilient closure is snap fit onto the container. The resilient closure has an end wall provided with a plurality of transverse grooves. A resin is deposited on the top surface of the end wall and into the grooves. If the closure is removed from the container, the top layer of resin and a portion of the resin in the grooves will fracture, thus indicating to the consumer that tampering with the container has occurred. A portion of the resin will remain in the grooves to provide a clear, visible indication that the resin was on the closure when it was initially sealed.

In another embodiment, the closure comprises a rotatable portion and a fixed portion. The rotatable and fixed portion have grooves which are filled with a resin. When the rotatable portion is pivoted away from the fixed portion to open the container, a portion of the resin fractures, thus indicating tampering with the container. A portion of the resin also remains in the grooves.

In another embodiment, the tamper evident closure comprises (a) a closure body having an end wall and a skirt depending from the end wall and (b) a closure lid movably secured to the closure body. The end wall and the closure lid define an upwardly open recess. A cured brittle layer is disposed in the upwardly open recess such that a portion of the layer contacts the end wall and another portion of the layer contacts the closure lid, whereby relative movement of the closure lid away from the end wall will cause a readily visible irreversible fracture of the layer and separation of at least one piece of the layer from the closure lid and the end wall. An associated method is also provided.

It is an object of the invention to provide a closure which has means indicating tampering with a package.

It is a further object of the invention to provide a closure made of elastic, resilient and/or flexible material which is snap fit onto a container.

It is a further object of the invention to provide the closure with an end wall containing a top layer of resin which fractures to indicate tampering with a package.

It is a further object of the invention to provide a closure which permits stacking one package on top of another without fracturing the resin disposed on the end wall of the closure.

It is a further object of the invention to provide grooves in the surface of the closure end wall underlying the top layer of resin that also contain the resin.

It is a further object of the invention to provide for some of the resin to remain in the grooves after fracturing of the top layer of resin to indicate that the container was originally manufactured with tamperproof resin.

It is a further object of the invention to provide indicia on the end wall which indicates if the top layer of resin has been fractured.

It is a further object of the invention to provide a child resistant container.

It is a further object of the invention to provide a flip top closure which has similar tamper evident resin filled grooves.

It is a further object of the invention to provide a fully "off-line" manufacture of a closure for subsequent securement to a container.

It is a further object of the invention to provide that the closure lid and the closure body can be made separately and with different colors and materials.

These and other objects of the invention will be fully understood from the following description of the invention with reference to the drawings appended to this application.

DESCRIPTION OF THE PREFERRED EMBODIMENT

Figure 1:
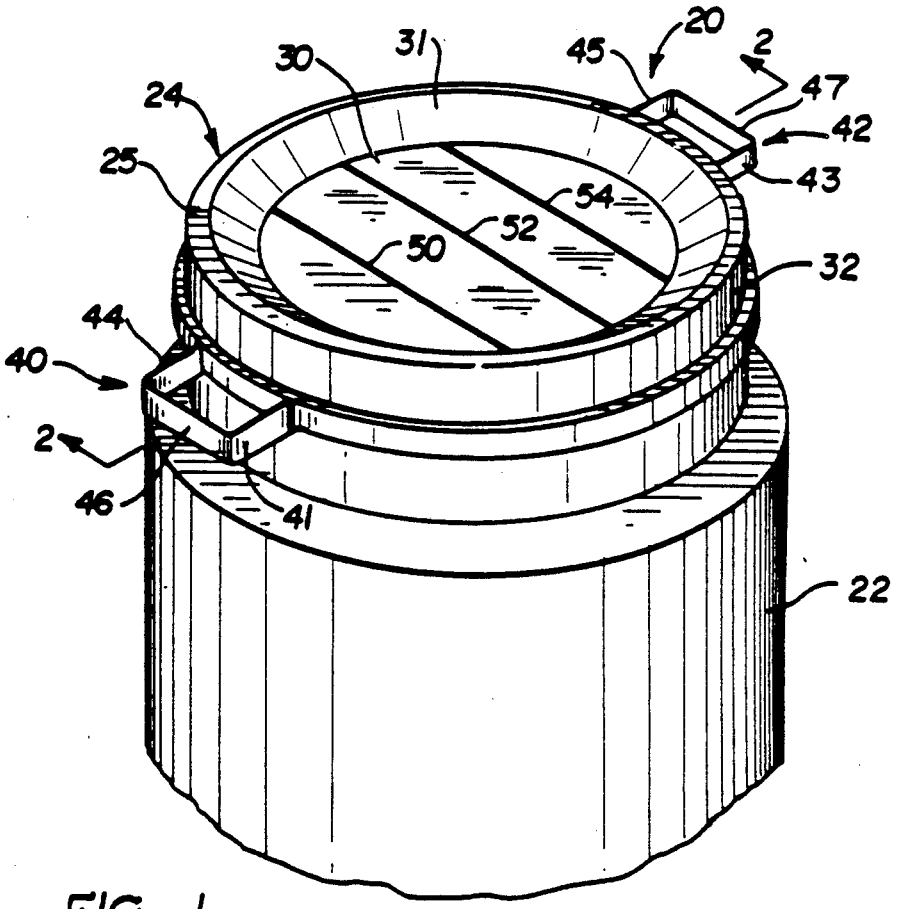
FIG. 1 is a perspective view of a container and closure of one embodiment of my invention.
Figure 2:
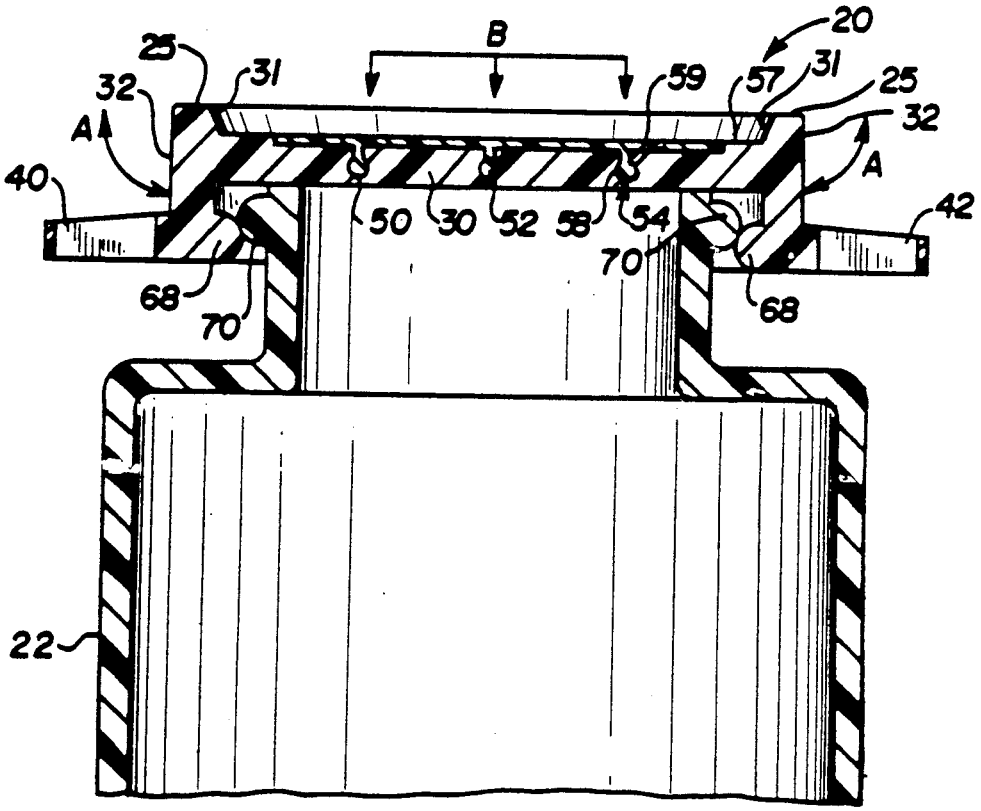
FIG. 2 is a cross-sectional view of the container and closure of FIG. 1 taken through line 2—2 of FIG. 1.

A package illustrating one of the embodiments of my invention is shown in FIGS. 1 and 2. The package 20 consists of a container body 22 and a closure 24. The container body 22 and closure 24 are shown as being generally round in plan, however, any shape can be utilized. The container body 22 can be made of any suitable material such as glass, metal or plastic or combinations thereof, for example. The material is preferably inflexible or inelastic so as to resist reversible deformation of the container body 22 opening. The closure 24 is preferably made of an elastic material which can bend and stretch when being put on and taken off the body 22. This elastic material can be polypropylene, polyethylene, rubber or a flexible metal, for example.

As shown in FIG. 2, the closure 24 has an annular top rim 25 which is spaced from the end wall 30 by annular generally vertically oriented shoulder portion 31 which connects the rim 25 with end wall 30. The shoulder portion 31 is preferably tapered as shown in FIG. 1 or may be a straight vertical edge. The end wall 30 forms a base which will be out of contact with a similar package which is placed on top of package 20. This arrangement will facilitate vertical stacking of the packages, without fracturing a resin layer that is disposed on the end wall 30.

The closure 24 has an annular depending skirt 32 and a pair of ears 40 and 42 which protrude from opposed sides of the lower portion of the annularly depending skirt 32. The ears 40 and 42 can be formed in any desired shape and are preferably integrally formed with the closure 22. The ears 40 and 42, as shown in FIG. 1, have, respectively, two sidewalls 41, 44 and 43, 45 joined by bridging wall 46, 47. The sidewalls 41, 44 and 43, 45 are shown forming an outwardly concave arc. It will be appreciated that any shape, size or form of ears 40 and 42 can be used. These ears 40 and 42 facilitate removing and replacing the closure 24 on the container body 22.

As can be seen in FIGS. 1 and 2, an upwardly open recess 49 and three upwardly open transverse grooves 50, 52 and 54 are formed in the top surface of the closure end wall 30. The recess 49 can be entirely filled with resin or only a portion of the recess 49 can be filled with resin. The recess 49 can have an area equal to or less than the area of the closure end wall 30. FIGS. 1 and 2 shows a resin deposited in the recess 49 and filling the grooves 50, 52 and 54. As can be seen in FIG. 2 the resin completely fills the grooves 50, 52 and 54 and forms a layer in recess 49. It will be appreciated that the resin will cover greater than about 50% of the top surface of closure end wall 30. If desired, a lesser quantity of resin and a lesser coverage percentage can be used, provided that the resin still fractures upon tampering with or adulteration of the container.

The cross-sectional shape of the grooves 50, 52 and 54 is shown in FIG. 2. Groove 54, for example, has a generally bulb-shaped base 58 and a recessed throat portion 59. The restricted throat 59 resists removal of the resin in bulb base 58. This groove shape will facilitate placing the resin into the groove 54. The resin in the bulb-shaped base 58 will remain therein after fracturing of the resin in the throat portion 59 to indicate to the consumer that the package was originally provided with the tamperproof resin. The identical resin is preferably deposited in the recess 49 and grooves 50, 52 and 54 at the same time.

The resin deposited into the recess 49 and the grooves 50, 52 and 54 preferably is ultraviolet ray curable to a brittle state. A preferred material is an epoxide resin such as a cycloaliphatic epoxide resin manufactured by Union Carbide Corp. of Danbury, Conn., and sold under the trade designation Envibar 1244. Alternatively, the resin could include a polyester base ultraviolet cured matte sold under the trade designation Polycure by Oriental Intl. of Tokyo, Japan, for example. As another alternative, a premixed ultraviolet light curable acrylate may be used such as, for example, those sold by the Loctite Corporation of Newington, Conn. Other materials of the Envibar line, such as K 231 and K 232 and also UV 1231, for example are suitable.

Cycloaliphatic epoxide products such as those mentioned herein and in my U.S. Pat. No. 4,890,763, are low-viscosity, miscible liquids that are easily combined. In order to obtain the appropriate properties with those materials, the resin should include photoinitiators. The process of this combination is sometimes referred to as "formulation". A suitable class of materials are the onium salt photoinitiators, sold under the trade designations CYRA CURE EVI-6974 and CYRA CURE UVI-6990 by Union Carbide Corp. and UVE-1014 and UVE-1016 by General Electric Company. More specifically, the cationic chemistry involved in the curing of adhesives, coatings, inks, and sealants deals with onium salt photoinitiators. These photoinitiators are blocked catalysts that are unblocked by the action of ultraviolet light. When the salts are exposed to ultraviolet light, they photolyze and chemically decompose under the action of ultraviolet light. Subsequently, they generate into a cationic species that acts as a catalyst or an initiator for polymerization of cycloaliphatic epoxides. In the presence of the generated cationic species, very rapid polymerization takes place.

The Envibar 1244 material is a general purpose base epoxide that has an excellent cure response and viscosity differentiation that facilitates formulation. Epoxide materials respond to ultraviolet light cure when they are combined with an appropriate photoinitiator. Aryldiazonium salts and arylidonium salts are suitable photoinitiators. When the base epoxides, such as Envibar 1244, are used alone as the only polymerizing ingredient in a formulation, hard, brittle coatings with good solvent resistance and adhesion result. This result is desirable for purposes of the present invention.

In order to prepare the formulation, the various ingredients may be simply combined or stirred by simple mixing for a suitable period, and then the coating and curing procedures are undertaken. The process should preferably be carried out under "yellow" light conditions in order to protect the preparation from ultraviolet light until curing is performed.

If desired, a material containing the photoinitiator may be employed. One suitable material for this purpose is that sold by Union Carbide under the trade designation ENVIBAR 1244. Another suitable material that can be used is acrylate because of its ability to be cured by short bursts of ultraviolet radiation or microwave radiation. A solvent base resin can also be used. The solvent is added to the resin and the solvent with added resin is cured by suctioning the solvent out from the resin.

Referring again to FIG. 2, the closure 24 has an inwardly projecting annular rib 68 formed on skirt 32 which is designed to snap fit over an outwardly projecting annular bead 70 disposed on the neck of container body 22 to seal the package 20. In order to remove the closure 24 from the body 22, one or both of the ears 40 and 42 of the closure 24 are bent upward and outward (in the directions of the arrows A on FIG. 2). This will force the annular rib 68 up and over the annular bead 70 thus releasing the closure 24 from the body 22. It will be appreciated that the illustration of two ears on the closure is not meant to be limiting and that no ears or one ear or more than two ears can be provided, if desired.

The action of removing the closure 24 from the body 22 will place downward pressure (shown by arrows B) on the end wall 30 of the closure 24. This downward pressure will in turn fracture the resin in the recess 49 and in the grooves 50, 52 and 54. The fractured pieces of resin may be removed from the end wall 30 or otherwise disposed of. The resin material in the recessed throat portion 59 may also fracture, however, the resin in the bulb-shaped base 58 will remain in the groove 54. This will indicate to a consumer that the package was originally manufactured with the resin.

After the resin fractures it can remain adhered to the closure or it can break into pieces which can fall off or be removed from the closure as desired.

Figure 3:
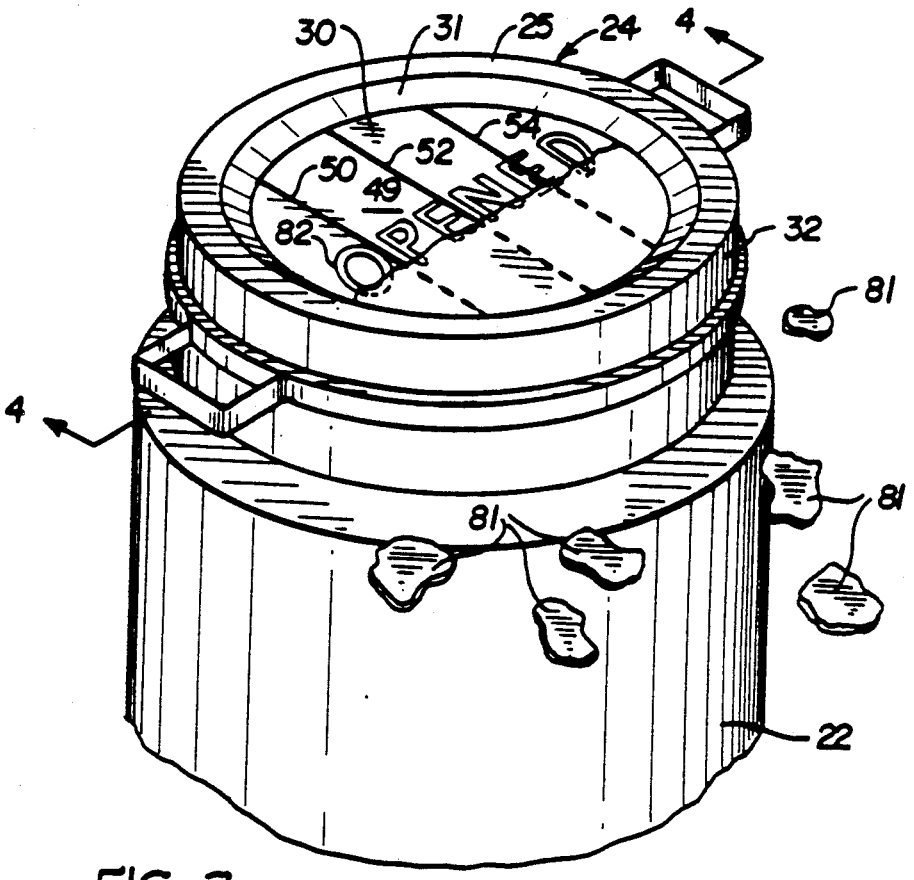
FIG. 3 is a perspective view of a package showing the closure having indicia which is exposed after the resin is fractured.

Referring to FIG. 3, a further embodiment of the tamper evident aspect of the package 20 will be further explained. Once the package 20 reaches the store shelf, the resin in the recess 49 and the grooves 50, 52 and 54 will be intact and will not be fractured. If the package 20 is tampered with by a person trying to lift the closure 24 off of the package 20, the upward and outward action of removing the closure will cause the resin in the recess 49 and in the grooves 50, 52 and 54 to fracture, thus indicating to a consumer that tampering has occurred. As shown in FIG. 3, pieces 81 of the resin will fracture and can be removed or will fall off of the closure end wall 30.

Another feature of the invention is shown in FIG. 3. The closure end wall 30 can have contained thereon indicia 82, such as the word "OPENED" or a skull and crossbones, for example. This indicia is preferably only visible to the consumer after the resin is fractured and falls off of the end wall 30. This can be accomplished by printing the indicia 82 in the same color as the tint of the resin applied to the end wall 30. This way the resin will mask the indicia 82 until such time as the resin fractures and is removed from the end wall.

Figure 4:
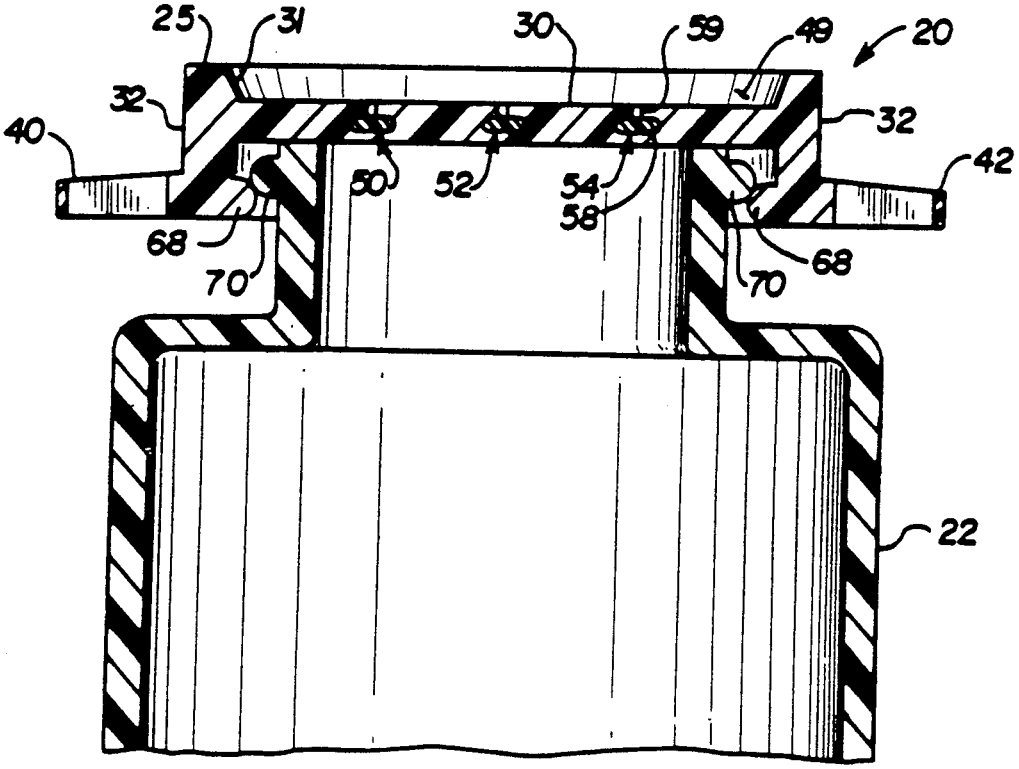
FIG. 4 is a cross-sectional view of the container and closure of FIG. 3 taken through line 4—4 of FIG. 3.

As can be seen in FIG. 4, the resin in the recess 49 and the resin in the throat portions (for example throat portion 59 of groove 54) is no longer present. However, a portion of the resin, after fracturing of the resin, remains in the bulb-shaped portion 58 of groove 54, for example. This shows that after the tampering has occurred and the resin has fractured, there will still remain remnants of the resin in the grooves 50, 52 and 54. This will indicate to the consumer not only that the tampering has occurred, but also that the closure was originally tamperproofed.

The resin filled grooves also act to childproof the container because it takes a certain amount of force to bend the closure and thus break the resin. The amount of force necessary to open the package 20 will depend on the amount of resin disposed in the recess of the end wall 30 as well as the number, shape and size of the grooves in the end wall 30.

Figure 5:
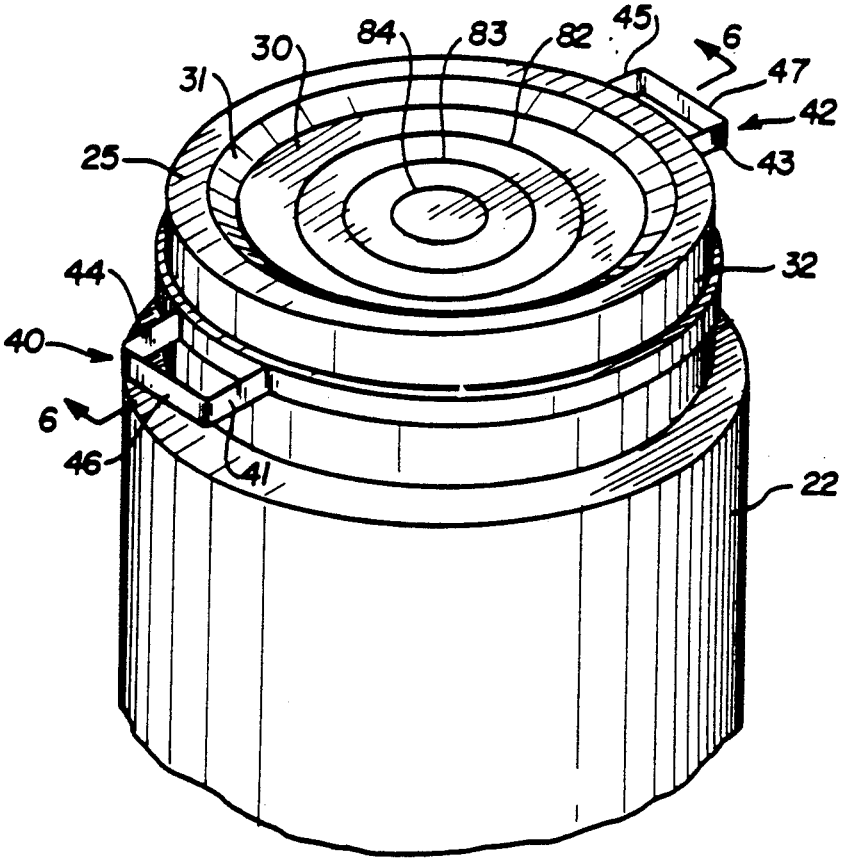
FIG. 5 is a perspective view of a package with a closure having concentric grooves.
Figure 6:
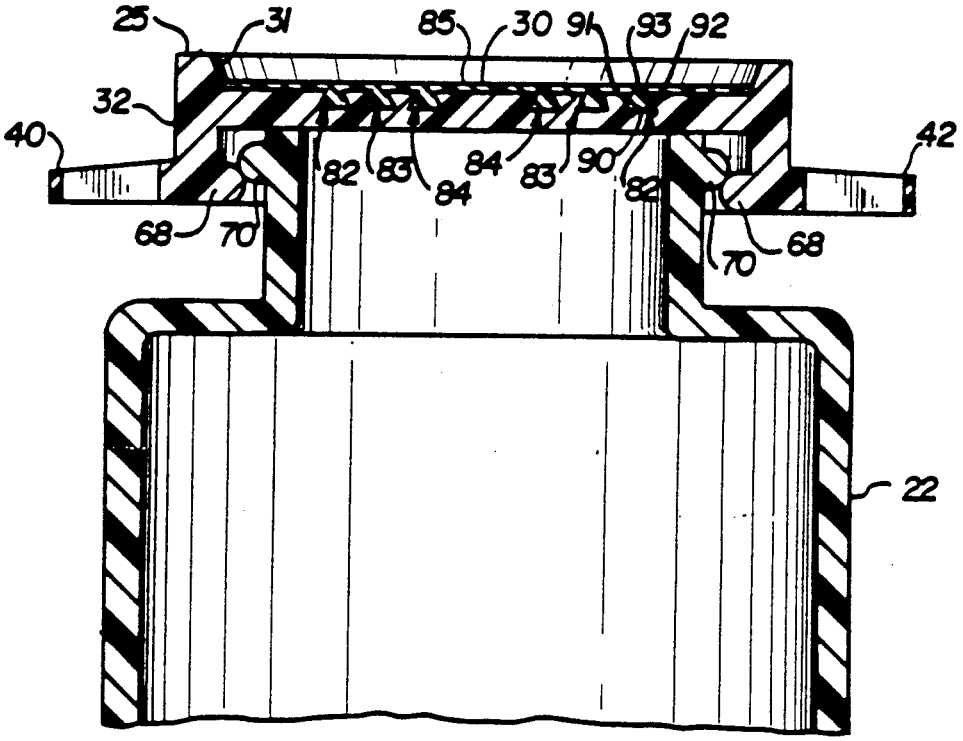
FIG. 6 is a cross-sectional view of the container and closure of FIG. 5 taken through line 6—6 of FIG. 5.

FIGS. 5 and 6 show another embodiment of the closure having a different groove pattern. In this embodiment, the grooves consist of three concentric circles 82, 83 and 84. It will be appreciated that any type of groove pattern can be used for the end wall, such as straight lines, s-curved lines, angled lines, and elliptical lines.

FIG. 6 shows a cross-sectional view of the grooves, 82, 83 and 84. Groove 82 (which is trapezoidal) has a base portion 90 and two upwardly and inwardly disposed sidewalls 91 and 92. The sidewalls 91 and 92 form a throat portion 93 which allows resin to enter the grooves. This cross-sectional shape not only facilitates entry of the resin into the grooves, but also provides a wider portion near the bottom of the groove so that an amount of resin will be present in the groove after the top layer of resin fractures to indicate tampering with the closure.

It will also be appreciated that the groove cross-sectional shape is preferably any pattern having a reversed tapered profile, whereby the base portion is wider than the throat portion so that resin may be deposited therein and so that a portion of the resin remains in the groove after fracturing of the top layer of resin. As explained hereinbefore, this shape will facilitate accomplishing an indication to consumers that the resin was applied when the package was initially manufactured. In the alternative, a groove profile having straight vertical edges forming a narrow groove can also be provided. Any groove profile which facilitates part of the resin fracturing with another part remaining in the groove after fracturing will be acceptable.

Another embodiment of the container is shown in FIGS. 7 to 10. This container 100 has a container body 102 and a closure 104 which is connected to the body 102 by a living hinge 106. The closure body end wall **102*a* has a depending closure body annular skirt 102*b* which in the form shown is received within and secured to the container body. The closure 104 has a closure lid or rotatable portion 108 having a closure lid end wall 104*b* and a closure lid annular skirt 104*c* which depends from the closure lid end wall 104*b*. The closure 104 may have internal serrations 105 that are complementary to external serrations 105*a* on the closure body annular skirt 102*b* so that the closure 104 can be intimately secured to the container 100. Other frictionally engaged surfaces may be employed. The closure 104 consists of a fixed portion 107 and a rotatable portion 108** and may be by an injection molding process, well known to those skilled in the art.

Figure 7:
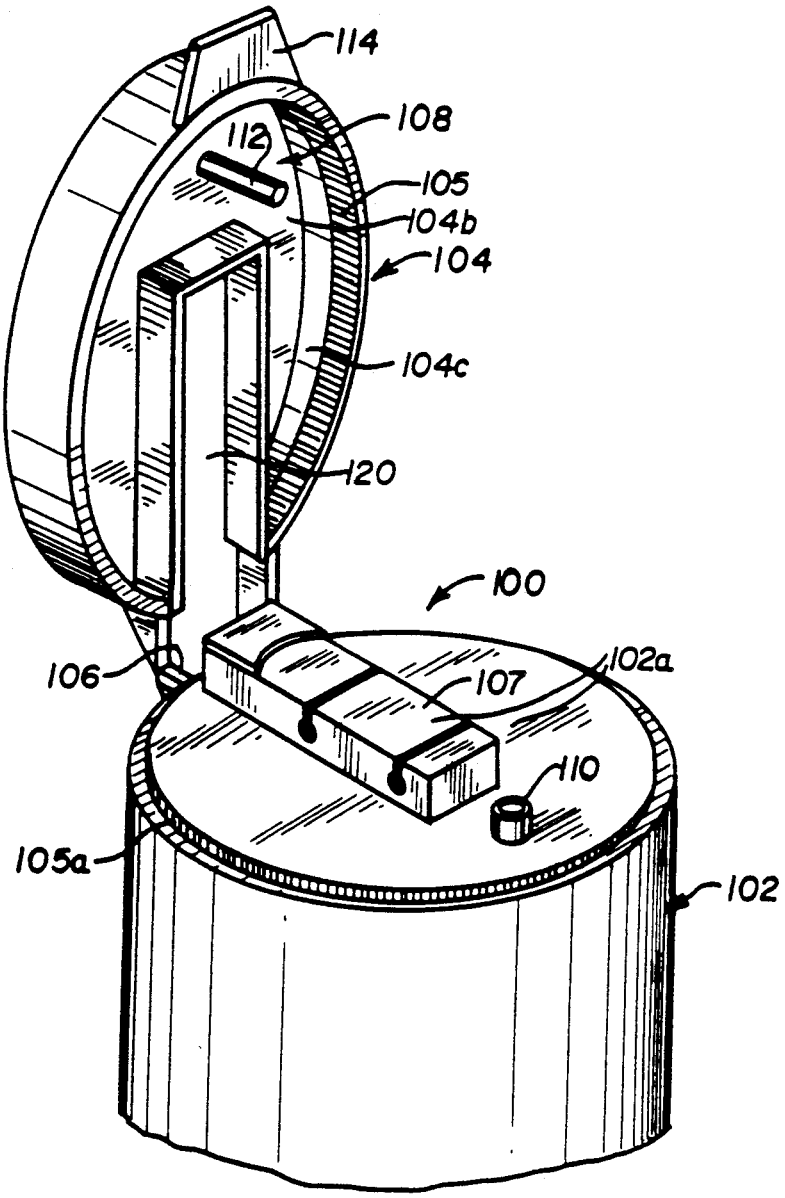
FIG. 7 is a perspective view of another embodiment of the container and closure of my invention.
Figure 9:
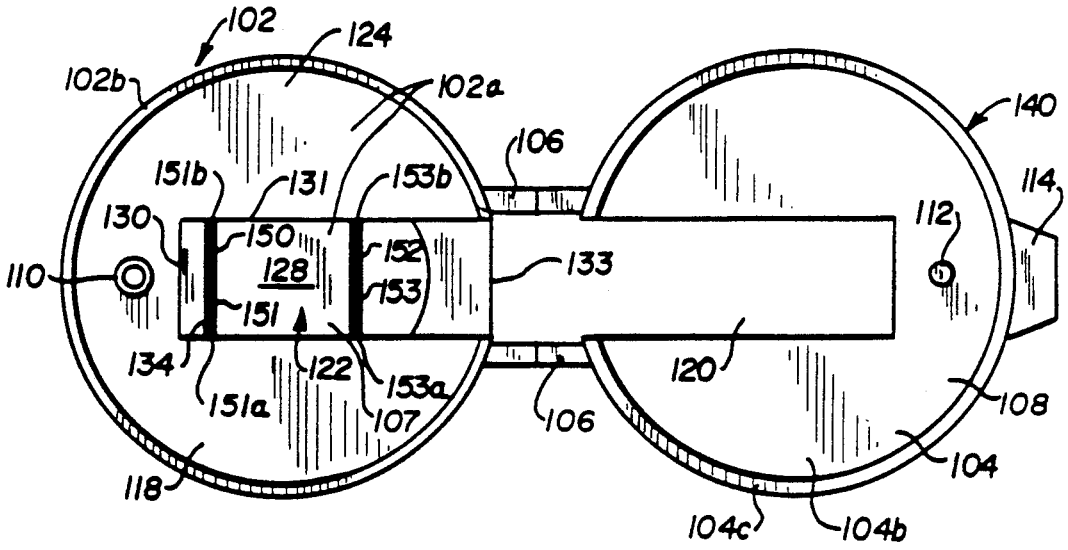
FIG. 9 is a top plan view of the container and closure of FIG. 7 when the closure is in an open position.
Figure 10:
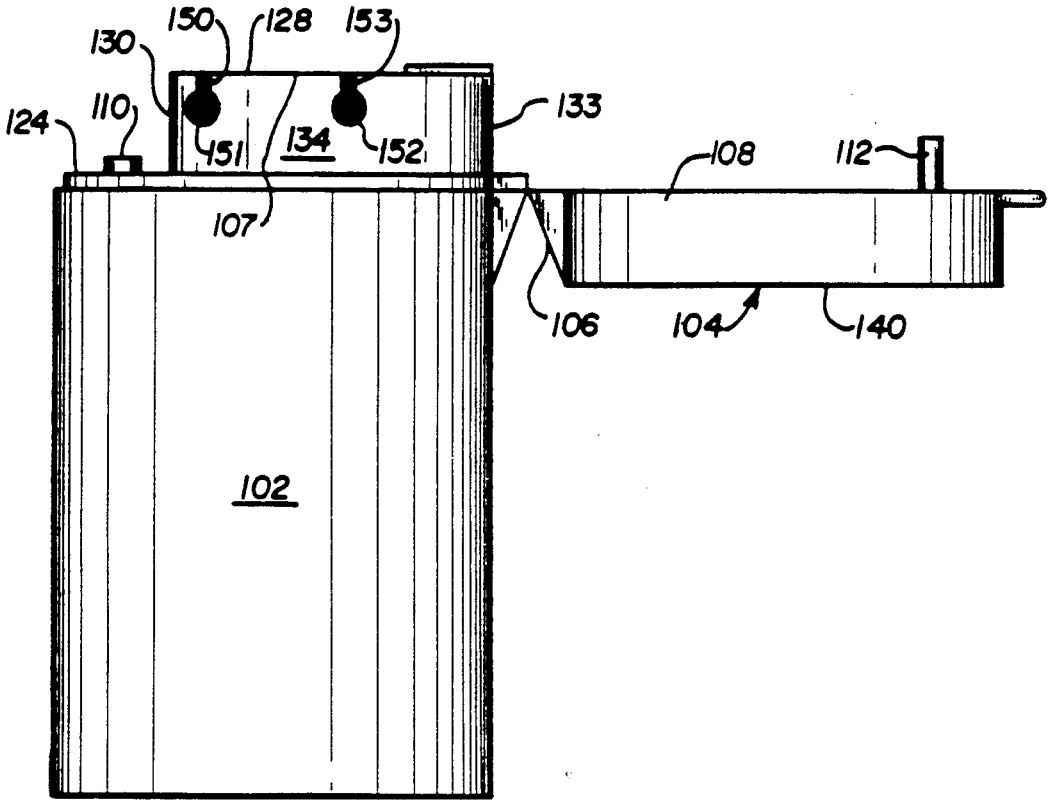
FIG. 10 is a side elevational view of the container and closure as shown in FIG. 9.

In the form shown, the fixed portion 107 has a dispensing opening 110 and the rotatable portion 108 has a form fitting stopper 112. The container 100 will be in a closed position when the rotatable portion 108 is secured to the top of the fixed portion 107. The container 100 will be in an open position where the rotatable portion 108 is pivoted away from the fixed portion 107 (FIGS. 7, 9 and 10). The closure 104 is also equipped with a tab 114 to facilitate pivoting the closure 104 on and off the container body 102.

Figure 8:
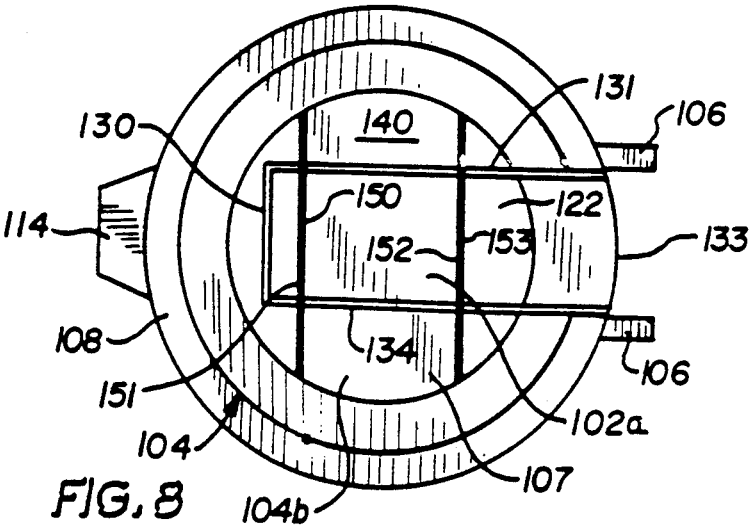
FIG. 8 is a top plan view of the container and closure of FIG. 7 with the closure in a closed position.

Referring now to FIGS. 8 through 10, the rotatable portion 108 defines an opening 120 which receives a portion 122 on the fixed portion 107. Portion 122 extends upwardly from a first surface 124 of the fixed portion 107 and is designed to be surrounded by the closure 104. The fixed portion 122 has an end wall 128 and four sidewalls 130, 131, 133 and 134. The rotatable portion 108 also has an end wall 140. As can be seen in FIG. 8, two grooves 150 and 152, containing the resin described hereinabove and having a cross-sectional shape shown in FIG. 10 (which, in turn, is similar to the grooves 50, 52, 54 described hereinbefore) are provided. These grooves 150 and 152 can take different shapes such as circles, curves or other shapes, for example, and can have different cross-sectional shapes as was discussed hereinbefore with respect to grooves 50, 52 and 54. These grooves 150, 152 are contained on both the fixed portion end wall 128 and the rotatable portion end wall 140.

When the container and the closure 104 are manufactured the resin is placed in the grooves 150 and 152. The resin forms resin bars 151 and 153 in the respective grooves 150 and !52. Container 100 arrives on the store shelf with the resin bars 151 and 153 intact. If the rotatable portion 108 is rotatably removed from the fixed portion 107, the resin in the bars 151 and 153 will each fracture at two locations **151*a* and 151*b* and 153*a* and 153*b*, thus indicating to the consumer that tampering with the package has occurred. As with the embodiment of FIGS. 1 and 2 a further advantage of the container 100 is that even after the tampering occurs and the resin has been fractured and falls off of the container and closure, there still will remain remnants of the resin bars 151 and 153 in grooves 150 and 152**. This will indicate to the consumer not only that the tampering occurred but also that the container was originally tamperproof when delivered from the manufacturer.

Additionally, the resin bars 151 and 153 provide child-proofing because of the increased resistance created by regulating the density and the resiliency of the closure in conjunction with the size of the groove, as well as varying the depth of the grooves and the composition of the resin. Varying these factors will determine the amount of force necessary to open the closure.

Figure 11:
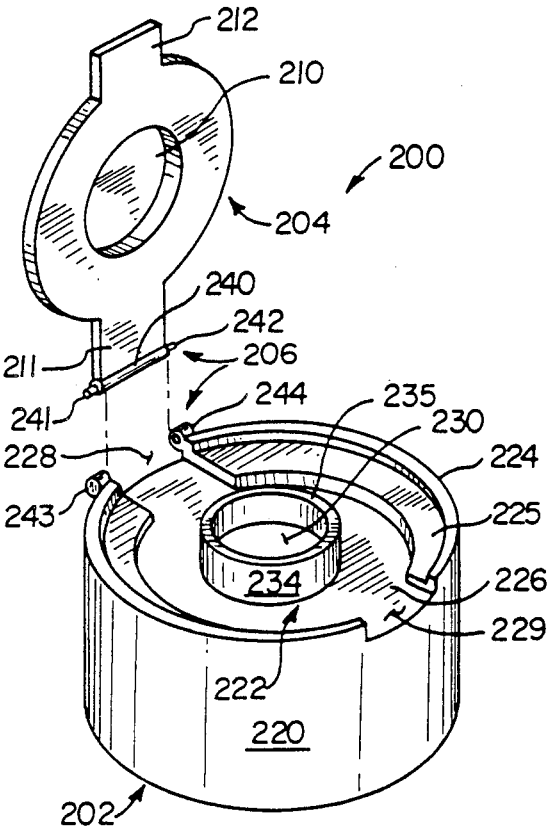
FIG. 11 is an exploded perspective view of another embodiment of the closure of the invention.
Figure 12:
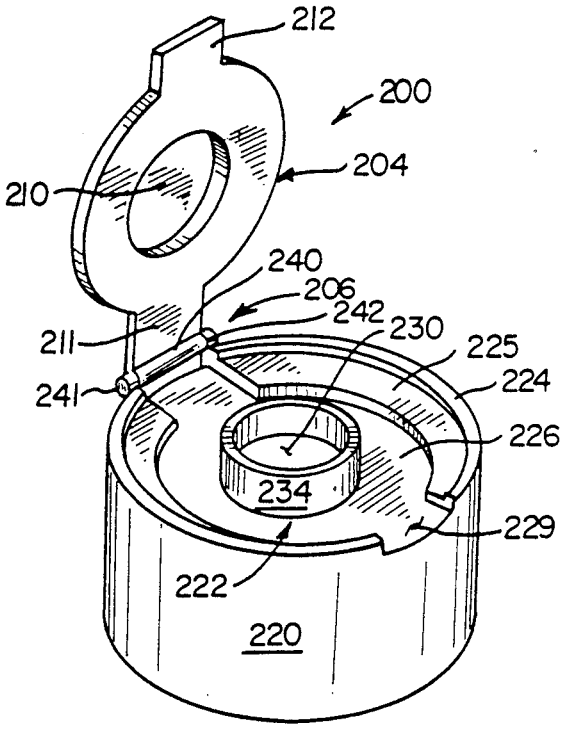
FIG. 12 is a perspective view of the closure of FIG. 11 showing the closure lid joined to the closure body by means of the hinge.
Figure 13:
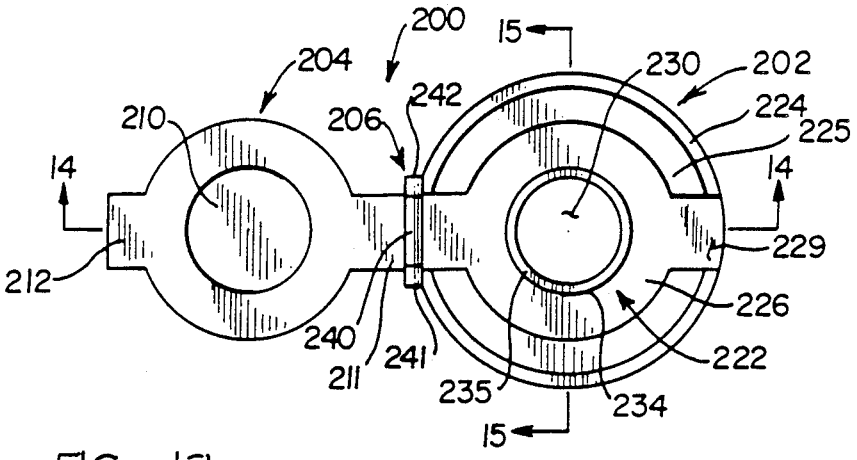
FIG. 13 is a top plan view of the closure of FIG. 12.
Figure 14:
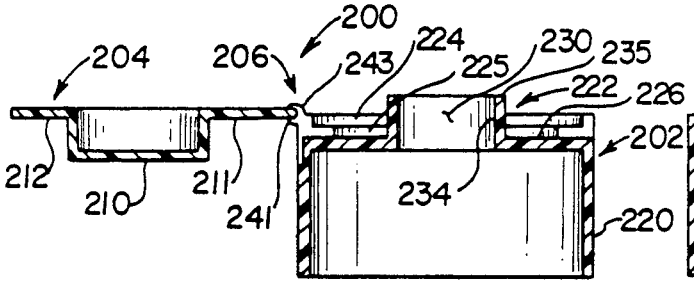
FIG. 14 is a cross-sectional view along line 14—14 of FIG. 13.
Figure 15:
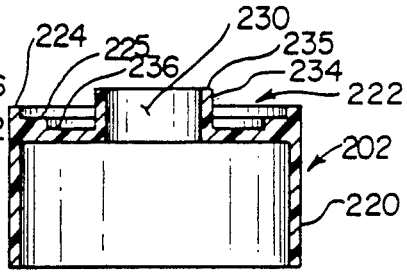
FIG. 15 is a cross-sectional view along line 15—15 of FIG. 13.

Another embodiment of the invention is shown in FIGS. 11–16. Referring particularly to FIG. 11, the closure 200 consists of a closure body 202 and a closure lid 204. The closure lid 204 is hingedly secured to the closure body 202 by hinge means 206. The closure 200 is made of any suitable material, such as plastic and can be made in any desired shape. It will be appreciated that the closure body 202 and closure lid 204 can be made as a separate two piece closure, without a hinge means 206. This choice will be made based on the product which is contained in the container to which the closure is applied. That is, if the product contained within the container is to be used more than a few times (for example, ketchup) the hinged version of the closure is preferred. If the product in the container is used only once or just a few times, the unhinged closure is preferred.

The closure lid 204 has extending therefrom a generally axially outwardly projecting embossment 210. The embossment 210, which is preferably hollow, is generally cylindrical and has a central axis which is generally coaxial (when closed) with the longitudinal axis of the closure lid 204. The closure lid 204 is generally circular and has a pair of opposed integrally formed generally radially extending tabs 211 and 212. Tab 211 forms a portion of hinge means 206. Tab 212 projects radially beyond the closure body 202 when the closure lid 204 is closed onto the closure body 202. This allows for tab 212 to be grasped to effect relative movement of the closure lid 204 away from the closure body 202 in effecting container opening.

The closure body 202 consists of an annularly depending skirt 220 and an end wall 222. The end wall 222 further consists of a discontinuous annular shoulder 224, a discontinuous annular ledge 225 spaced radially inwardly from the shoulder 224 and an end wall seating area 226 which is spaced radially inwardly from the annular ledge 225. The annular shoulder 224 and the annular ledge 225 project generally axially outwardly from the end wall 222. The shoulder 224 and ledge 225 define discontinuities or recesses 228 and 229. As can be seen, tab 211 is operatively associated with the recess 228 and recess 229 receives tab 212.

The end wall 222 also has a spout opening 230 for dispensing the product contained in the container. The spout opening 230 is defined by a continuous generally axially outwardly projecting annular sidewall 234. Sidewall 234 will aid in resisting undesired entry into the container of pieces of the brittle layer 260 (discussed hereinbelow). The spout annular sidewall 234 is dimensioned so as to be received within and frictionally engage the embossment 210 of the closure lid 204 when the closure lid 204 is in a closed position with respect to the closure body 202.

The hinge means 206 consists of a rod 240 disposed on the free end of tab 211. The rod 240 has two free ends 241 and 242 that extend outwardly from tab 211. The free ends 241 and 242 are designed to be received with receiving members 243 and 244 disposed on the exterior surface of the closure body 202. It will be appreciated that this hinge means is only one of numerous hinges that may be employed and is set forth for illustration purposes only.

It will be appreciated that a continuous spout sealing means (not shown) such as a thermoplastic sheet can be secured to the free end 235 of spout opening 230 by known processes such as heat-by-contact or ultrasonic welding. As is known, spout sealing means provide a form of tamper evident protection, however there is a disadvantage with this process in that it is necessary to tear or puncture the seal using a sharp object. Often times, the seal is difficult to remove completely and sometimes pieces of the seal get into the container. Also, when the seal is used in conjunction with a hinged closure, the manufacturer must use threaded closures loosely attached to the container. The consumer then, at home, removes the closure, removes the seal and replaces the lid. This involves several steps and is undesired.

Figure 16:
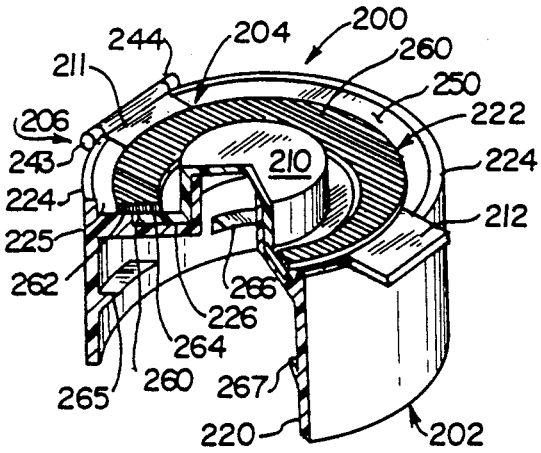
FIG. 16 is a perspective view, partially in section, of the closure of FIG. 12 showing the closure lid closed upon the closure body and showing the cured brittle layer of the closure.

Referring particularly to FIG. 16, it can be seen that the embossment 210 of the closure lid 204 and the annular shoulder 224 define a recess 250 in the closure. A resin is placed in the recess and cured to form a cured brittle layer 260. The cured brittle layer 260 is positioned such that a portion 262 of the layer 260 contacts the end wall 222 and another portion 264 of the layer 260 contacts the closure lid 204. As will be appreciated, relative movement of the closure lid 204 away from the end wall 222 will cause a readily visible irreversible change in the layer 260 through separation of at least one piece of the layer 260 from the closure lid 204 and the end wall 222. The pieces of the brittle layer will be resisted from entering the container through the spout 230 by means of the spout annular sidewall 234. The resin composition and characteristics were described hereinabove and will not be repeated here.

FIG. 16 also shows segments 265, 266 and 267 which are spaced in a circumferential manner on the interior surface of the skirt 220. A fourth segment is not shown. These segments project both generally axially from the interior of the skirt 220 and generally radially inwardly from the interior of the skirt 220. The segments are evenly spaced along the inner circumference of the skirt 220. The segments anchor the closure 200 to a container neck as will be explained hereinbelow with reference to FIG. 19.

Figure 17:
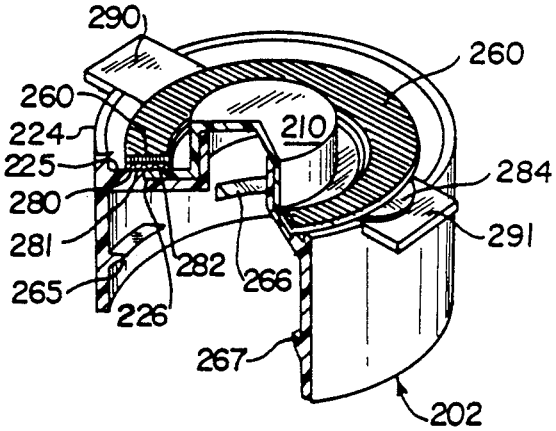
FIG. 17 is a perspective view, partially in section, of another embodiment of the closure of the invention.

Another embodiment of a closure in accordance with the invention is shown in FIG. 17 where like parts to those of FIG. 11 are identified by like reference characters. In this embodiment a label 280 is affixed by adhesives or ultrasonic welding to the end wall 222. The label 280 has a portion 281 contacting the end wall 222 and another portion 282 contacting the closure lid 204. The label 280 is made of materials selected from the group consisting of polyurethane, polyethylene and polyester. These materials have the property of permanently deforming when the label 280 is peeled off the end wall such that if the labels 280 are placed back on the end wall 222 there will be obvious evidence of tampering. These materials will also aid in having all pieces of the layer fall off the end wall easily. It will be appreciated that the label 280 will seal the closure, thus making it unnecessary to provide a spout sealing means as was referred to above. The label 280 is provided with a tab 284 to facilitate removal thereof from the end wall 222.

The resin is placed on top of the label 280 and then subsequently cured to form a brittle layer 286 thereon. The brittle layer 286 is bonded to the label 280. Thus, when the label 280 is peeled away from the end wall 222, the cured brittle layer will fracture, further indicating to the consumer that the package has maintained its factory seal.

FIG. 17 also shows an unhinged version of the closure of the invention. This closure has two opposed radially extending tabs 290 and 292 which can be grasped to facilitate removing the closure lid from the closure body.

Figure 18:
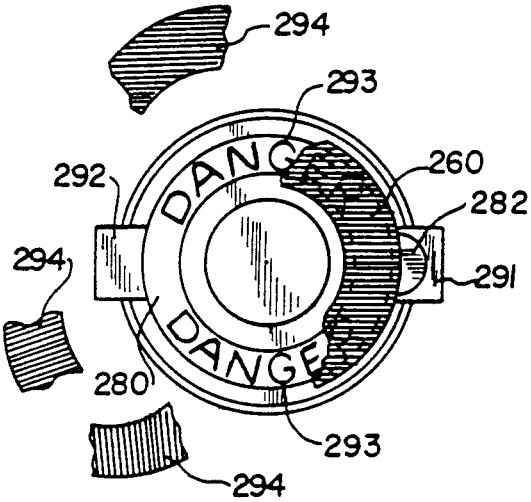
FIG. 18 is a top plan view of the closure in a closed position showing the warning label indicia.

Referring to FIG. 18, the label 280 can also be provided with warning message indicia 293 such as the word "DANGER" to indicate that the layer 286 has been removed from the closure. This warning message indicia 293 will alert consumers that tampering with or adulteration of the container has occurred. It will be appreciated also that the warning message indicia 293 can be printed on the closure 200 such that when the label 280 and layer 286 is removed, the warning message indicia 287 will be exposed. FIG. 18 also shows pieces 294 of the layer 286 which have been separated from the label 280.

Figure 19:
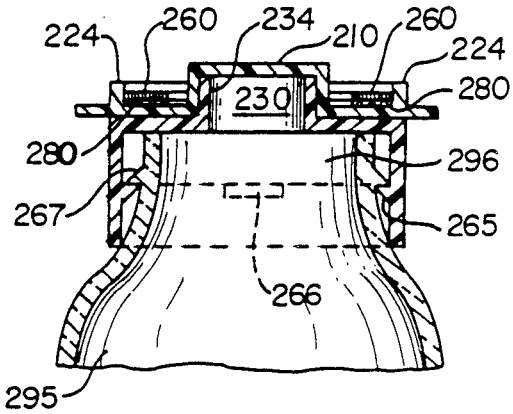
FIG. 19 is a perspective view, partially in section, of another embodiment of the closure showing the closure anchored to the container.

Referring to FIG. 19 the closure 200 is shown on a container 295. The container 295 has a continuous rib 296 which along with the segments 265–267 and the fourth segment (not shown) anchors the closure to the container 295. The segments can be bevelled from bottom to top (thin at the bottom, thick at the top) in order to more easily be pushed down over the rib 296 and to better engage the rib 296 after being pushed down thereon. As can be seen in FIG. 19, when anchored, the segments are positioned underneath the rib 296 and engage the rib 296 to resist the closure 200 from being separated from the container 295.

It will be appreciated that the label with the cured brittle layer can be applied in one step by applying the resin to the label and curing the resin "off-line" and then moving the label with brittle layer to the closure production line for subsequent placement thereon.

In accordance with the invention, the closure lid 204 and the closure body 202 can be molded separately and then hingedly joined or otherwise secured to each other at a subsequent time. Because of this, the closure lid 204 can be made a first color and the closure body can be made a second color. This can enhance marketing of the product.

In addition, the closure lid can be made from a first material and the closure body can be made from a second material. For example, the closure body can be made from polypropylene and the closure lid can be made from polyvinylchloride. This permits a wider selection of resins to be used in association with the invention, as the adhesion performance of the resin depends on the materials used in the manufacture of the closure. Using the above example, acrylic resins adhere extremely well to polypropylene whereas acrylic resins do not adhere well to polyvinylchloride. In this way, the cured brittle layer will more completely separate from the closure lid than from the closure body upon relative movement of the closure lid away from the closure body.

The method of the invention involves providing a closure lid 204 and closure body 202 and placing tamper evident means in the recess such that a portion of the tamper evident means contacts the end wall and another portion of the tamper evident means contacts the closure lid. The tamper evident means can be (i) a resin which is deposited in the recess which is subsequently ultraviolet cured to form a brittle layer (ii) a label affixed to the end wall with a resin deposited thereon which is subsequently cured to form a brittle layer or (iii) a label with a pre-applied brittle layer. The tamper evident means is characterized by a propensity to irreversibly fracture and at least in part separate from the end wall and the closure lid when the closure lid is moved away from the closure body end wall. The closure is then stored or accumulated for subsequent sequential application to containers.

In the method of the invention, the brittle layer 260 should not be fractured when the closure 200 is placed on the container. Conventionally, the closure 200 is placed on a container by using a machine that presses or "hammers" the closure onto the container. Referring to FIG. 16, the design of the closure 200 is such that the "hammer" will contact the annular shoulder 224 and/or the embossment 210. These areas will absorb the impact of the blow on the closure 200 and thus will resist premature fracturing of the cured brittle layer 260. Also, this design will resist applying a moment force on the brittle layer 260 thus resisting fracturing of the layer 260.

The method of the invention provides a system which may be employed for totally "off-line" manufacturing of a closure for subsequent placement on a container. That is, the producer or packer of the goods in the container does not need to apply any tamper evident means "on-line". The closure, with the tamper evident means is prepared totally "off-line" either at a separate manufacturing plant or a separate area away from the production line. The closures can be accumulated for subsequent securement to containers or can be stored. The stored closures can be nested so as to allow efficient and neat accumulation and storage thereof.

Although a separately molded closure body and lid has been disclosed, it will be appreciated that a unitary closure comprising a closure body and a lid with an integral hinge can be provided.

Although only one type of package shape has been disclosed herein, it will be appreciated that the invention can be used with many different shapes and sizes of packages, holding a wide variety of products such as foods and medication, for example.

Any references herein to orientation such as top, bottom, left, right, upper and lower for example are not limiting, and are used solely for convenience of reference.

It will be appreciated that the invention provides a closure having a closure lid and a closure body defining an upwardly open recess in which a cured brittle layer is disposed. The cured brittle layer will be fractured and separation of at least one piece of the layer will occur upon relative movement of the closure lid to the closure body.

Whereas a particular embodiment has been described hereinabove, for purposes of illustration, it will be evident to those skilled in the art that numerous variations of the details may be made without departing from the invention as defined in the appended claims.

I claim:

1. A tamper evident closure for a container comprising:

a closure body having an end wall and a skirt depending from said end wall;

a closure lid movably secured to said closure body;

said end wall and said closure lid defining an upwardly open recess; and a cured brittle layer disposed in said recess such that a portion of said layer contacts said end wall and another portion of said layer contacts said closure lid, whereby relative movement of said closure lid away from said end wall will cause a readily visible irreversible fracture of said layer and separation of at least one piece of said layer from at least one of said closure lid and said end wall.

2. The closure of claim 1, including said closure lid having an embossment extending generally axially outwardly from the surface of said closure lid.

3. The closure of claim 2, wherein said embossment is generally cylindrical and has a central axis which is generally coaxial with the longitudinal axis of said closure lid when said closure is in a closed position.

4. The closure of claim 3, wherein said closure lid is generally circular and has a pair of opposed generally radially extending tabs.

5. The closure of claim 4, wherein said first tab forms a portion of a hinge which permits relative rotational movement of said lid with respect to said closure body.

6. The closure of claim 5, wherein said second tab projects radially beyond said skirt, whereby said second tab can be grasped to effect relative movement of said closure lid away from said end wall.

7. The closure of claim 6, including said end wall having a generally annular shoulder section extending generally axially outwardly from the surface of said end wall and disposed generally radially outwardly from said embossment.

8. The closure of claim 7, wherein said shoulder section has a pair of discontinuities, a first discontinuity being operatively associated with said first tab and a second discontinuity receiving said second tab, whereby said recess is defined by said embossment and said shoulder section.

9. The closure of claim 8, wherein said hinge includes said first tab and a tab receiving portion on said closure body.

10. The closure of claim 9, wherein said first tab has a transverse rod and said tab receiving portion includes a pair of spaced apart receiving portions which receive said rod to hingedly secure said closure lid to said closure body.

11. The closure of claim 10, wherein said layer is comprised of a material selected from the group consisting of an ultraviolet curable cycloaliphatic epoxide resin, a microwave curable acrylic resin, an ultraviolet curable acrylic resin and a solvent base resin.

12. The closure of claim 11, including
a spout defined by said end wall through which the contents of said container can be dispensed.
13. The closure of claim 12, wherein
said spout is defined by a generally axially outwardly projecting annular wall, whereby entry of said pieces of said layer into said container is resisted.
14. The closure of claim 13, wherein
said embossment is hollow and is dimensioned so as to frictionally engage said spout defining annular wall when said closure lid is in a closed position with respect to said closure body.
15. The closure of claim 14, including
spout sealing means secured to the free end of said annular wall.
16. The closure of claim 1, including
a label disposed underneath said layer, said label having a portion contacting said end wall and another portion contacting said closure lid and said layer being secured to said label.
17. The closure of claim 16, wherein
said label is made of materials selected from the group consisting of polyurethane, polyethylene and polyester, whereby when said label is pulled off said closure, it will permanently deform to further indicating tampering with said closure.
18. The closure of claim 17, wherein
said label has indicia printed thereon, whereby when portions of said layer are removed said indicia is readily visible.
19. The closure of claim 18, wherein
said indicia is a warning message.
20. The closure of claim 1, wherein
said closure body is made of a first material and
said closure lid is made of a second material.
21. The closure of claim 20, wherein
said closure body is a first color and
said closure lid is a second color.
22. The closure of claim 21, wherein
said first material is polypropylene and
said second material is polyvinylchloride.
23. The closure of claim 1, including
said closure lid is completely separable from said end wall.
24. The closure of claim 23, wherein
said closure body is made of a first material and
said closure lid is made of a second material.
25. The closure of claim 24, wherein
said closure body is a first color and
said closure lid is a second color.
26. The closure of claim 25, wherein
said first material is polypropylene and
said second material is polyvinylchloride.
27. A method of making a tamper evident closure for a container comprising the steps of:
providing a closure body having an end wall and a skirt;
providing a closure lid removably secured to said closure body;
providing in said closure an upwardly open recess;
placing tamper evident means in said recess such that a portion of said tamper evident means contacts said end wall and another portion of said tamper evident means contacts said closure lid;
said tamper evident means, when cured, characterized by a propensity to irreversibly fracture and at least in part separate from said end wall and said closure lid when said closure lid is moved away from said end wall; and
accumulating a plurality of said closures prior to sequential application thereof to said containers.
28. The method of claim 27, further including
storing said closure for subsequent placement on said container.
29. The method of claim 28, further including
storing said closures in a nested fashion.
30. The method of claim 27, further including
said tamper evident means placing step is depositing a resin into said recess and
subsequently prior to said securement of said closure to said container, curing said resin to form said tamper evident means.
31. The method of claim 27, further including
said tamper evident means placing step is affixing a label to said recess;
depositing a resin on said label; and
subsequently prior to said securement of said closure to said container, curing said resin to form said tamper evident means.
32. The method of claim 31, further including affixing said label by ultrasonic welding.
33. The method of claim 27, further including
said tamper evident means placing step is effected prior to securement of said closure to said container by affixing to said recess a label having a cured brittle layer disposed thereon.
34. The method of claim 33, further including
providing said label with an adhesive portion and
affixing said label to said recess by pressing said adhesive portion against the surface of said recess.
35. The method of claim 27, further including
employing a first color for said closure lid and a second color for said closure body.
36. The method of claim 27, further including
employing a first material for said closure body and a second material for said closure lid.
37. The method of claim 36, further including
employing polypropylene as said first material.
38. The method of claim 37, further including
employing polyvinylchloride as said second material.
39. The method of claim 27, further including
forming said closure lid with a generally axially outwardly projecting embossment.
40. The method of claim 39, further including
forming said closure body with a generally axially outwardly projecting shoulder section.
41. The method of claim 27, further including
providing hinge means to hingedly connect said closure lid to said closure body.
42. The method of claim 41, further including
providing a spout in said closure body end wall which is defined by a generally annular wall and
securing sealing means to the free end of said annular wall, whereby escape of the contents of said container can be resisted.
43. The method of claim 42, further including
applying said sealing means by ultrasonic welding.

* * * * *